US008653758B2

(12) United States Patent
Radermacher et al.

(10) Patent No.: US 8,653,758 B2
(45) Date of Patent: Feb. 18, 2014

(54) CIRCUIT FOR AND A METHOD OF SENSING A PROPERTY OF LIGHT

(75) Inventors: Harald Josef Günther Radermacher, Aachen (DE); Christoph Martiny, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 149 days.

(21) Appl. No.: 13/319,121

(22) PCT Filed: Apr. 29, 2010

(86) PCT No.: PCT/IB2010/051871
§ 371 (c)(1), (2), (4) Date: Nov. 7, 2011

(87) PCT Pub. No.: WO2010/128435
PCT Pub. Date: Nov. 11, 2010

(65) Prior Publication Data

US 2012/0056545 A1 Mar. 8, 2012

(30) Foreign Application Priority Data

May 8, 2009 (EP) ..... 09159734

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/309

(58) Field of Classification Search
USPC ..... 315/309
See application file for complete search history.

(56) References Cited

U.S. PATENT DOCUMENTS

| | | | | |
|---|---|---|---|---|
| 5,828,178 | A | 10/1998 | York et al. | |
| 6,400,099 | B1 * | 6/2002 | Walker | 315/291 |
| 6,630,801 | B2 | 10/2003 | Schuurmans | |
| 6,759,814 | B2 * | 7/2004 | Vogel et al. | 315/312 |
| 7,330,002 | B2 | 2/2008 | Joung | |
| 2007/0035740 | A1 | 2/2007 | Nisper et al. | |

FOREIGN PATENT DOCUMENTS

| | | | |
|---|---|---|---|
| EP | 1349432 | A1 | 10/2003 |
| WO | 9901012 | A1 | 1/1999 |
| WO | 0037904 | A1 | 6/2000 |

* cited by examiner

*Primary Examiner* — Jany Richardson
(74) *Attorney, Agent, or Firm* — Yuliya Mathis

(57) ABSTRACT

In a circuit (1) for sensing a property of light there are provided a first circuit element (7) that is sensitive to light and that is realized to generate an output signal (I1) during a measurement time period (ΔtM), wherein the output signal (I1) is generated according to light to which the first circuit element (7) is exposed and the temperature (T) of the first circuit element (7), and a second circuit element (8) that is realized to increase the temperature (T) of the first circuit element (7) during a warming time period (ΔtW) that precedes the measurement time period (ΔtM).

16 Claims, 4 Drawing Sheets

CIRCUIT FOR AND A METHOD OF SENSING A PROPERTY OF LIGHT

FIELD OF THE INVENTION

The invention relates to a circuit for sensing a property of light.

The invention further relates to a method of sensing a property of light.

BACKGROUND OF THE INVENTION

In the field of color tunable multi LED luminaries or multi LED lamps, color control is a crucial topic in order to achieve and maintain color point accuracy. Color points or, more generally, colors are quantified by chromaticity coordinates, of which the most widely used are the CIE (Commission International de l'Eclairage) 1931 chromaticity coordinates. Here the combination of x and y defines the color and L defines the brightness, i.e. luminosity, of the light. This system is based on the response of the eye of the average observer and is the internationally accepted standard. The requirement to control the color point is basically triggered by various inherent problems related to the LEDs used in such a luminary. For example, the optical characteristics of individual LEDs vary with temperature, forward current, and aging. In addition, the characteristics of the individual LEDs vary significantly from batch-to-batch for the same LED fabrication process and from manufacturer to manufacturer. Therefore the quality of the light produced by the LED luminary can vary significantly and the desired color and the demanded brightness of the light cannot be obtained without suitable feedback systems.

Such a feedback system is typically realized by at least one sensor. Obviously, on the one hand the selection of the type of sensor strongly depends on the demanded accuracy or performance of the sensor and on the other hand on the economic impact of the sensor's price on the total product price. In this context, one of the big challenges is to correctly represent the effect of wavelength drift in the light emitted by the luminary. This challenge finds its basis in the fact that sensitivity of the human eye shows significant peaks in the so-termed color matching function that describes the color perception of the human eye, wherein said peaks are not present in the spectral response of a simple photodiode when used as a light sensitive element of the sensor. Hence, such a sensor might enable precise measurements of the radiometric flux of a certain primary color and allow keeping the radiometric flux of a lamp constant, but still the actual color of the emitted light as perceived by the human observer may deviate from the desired color because the said simple photodiode doesn't track the wavelength drifts of the primary color(s) induced by temperature variations or aging. In order to deal with this phenomenon, complex models representing aging or temperature behaviour are required. But also ambient light that is not perfectly shielded from the sensor's photodiode might disturb the sensor's measurements and consequently leads to a mismatch between the actual color perception and the desired color perception. The situation turns even worse if the sensor is used to achieve a constant illumination in a certain location while ambient light or contributions from other light sources influence the integral measurements obtained by the simple photodiode.

On the other hand, the problems identified in terms of a purely photodiode-based sensor might be overcome by using more advanced sensor arrangements. For example, the use of a spectrometer that provides a very high spectral resolution would allow thorough analyses of the spectral property of the light emitted by the LED luminary. However, the pricing target for the LED luminary does not allow the use of such spectrometers.

The latter problem might be overcome by applying a true color sensor, which is realized to take the color perception of the human eye into account. Such a true color sensor typically comprises at least three photodiodes, each of which is equipped with a color filter. For example, a circuit for sensing a property of light in the form of a multi-photodiode true color sensor is disclosed in U.S. Pat. No. 6,630,801 B2. The sensor realizes a first circuit element and comprises filtered photodiodes and unfiltered photodiodes. A further circuit element coupled to the sensor measures the output signal of the filtered and unfiltered diodes and correlates these readings to chromaticity coordinates for each of the red, green, and blue LEDs of the luminary. Based on this correlation, forward currents driving the LEDs of the luminary are adjusted in accordance with differences between the chromaticity coordinates of each of the red, green, and blue LEDs and chromaticity coordinates of a desired mixed color light. Although this solution achieves desired results in terms of color control, its realization still requires a significant number of sensor elements in combination with appropriately realized and manufactured filters, which in total does not allow a cost efficient and compact design.

Therefore, it is an object of the invention to provide a circuit for sensing a property of light having an improved and more cost efficient circuit design. It would also be desirable to provide a method of sensing a property of light that shows an improved performance while at the same time a more cost efficient implementation is enabled.

SUMMARY OF THE INVENTION

This object is achieved by a circuit for sensing a property of light, which circuit comprises a first circuit element that is sensitive to light and is realized to generate an output signal during a measurement time period, wherein the output signal is generated according to light to which the first circuit element is exposed and the temperature of the first circuit element, and a second circuit element that is realized to increase the temperature of the first circuit element during a warming time period that precedes the measurement time period.

This object is also achieved by a method of sensing a property of light using a circuit that comprises a first circuit element and a second circuit element, which method comprises the steps of exposing said first circuit element to light, and increasing the temperature of said first circuit element by means of said second circuit element during a warming time period that precedes a measurement time period, and generating an output signal by means of said first circuit element during the measurement time period, wherein the output signal is generated according to the light to which the first circuit element is exposed and the temperature of the first circuit element.

The step of exposing the first circuit element to light and the step of increasing the temperature of the first circuit element may be applied in this order or may be applied in reverse order without departing from the gist of the invention.

By providing these measures, it is advantageously achieved that only one simple and relatively inexpensive circuit element can be used for sensing not only the integral properties of the light, e.g. the flux, but also spectrometric properties, which can be derived by making use of the temperature dependency of said single light-sensitive first circuit element instead of applying a number of light sensitive circuit elements and equipping each with a filter.

With regard to the timing of the warming time period and the measurement time period, it can be mentioned that the measurement time period will typically follow the warming time period, because one aspect of the invention is found in the insight to measure the output signal during the cooldown phase of the first circuit element. However, it is also of certain importance to acquire information regarding the temperature of the first circuit element. Therefore it is feasible to completely or partly overlap the measurement time period and the warming time period, while making sure that the measurement time period still extends in a time span following the end of the warming time period. With regard to measurements or signals or the processing of such signals performed during the measurement time period, the time span of coexistence of the warming time period and the measurement time period may be used to acquire information regarding the temperature of the first circuit element. The remaining time span of the measurement time period following the end of the warming time period may be used for deriving the light property of the light from the output signal.

The dependent claims and the subsequent description disclose particularly advantageous embodiments and features of the invention, wherein, in particular, the method according to the invention may be further developed according to the dependent circuit claims.

The first circuit element may, for example, be realized by means of a photoreceptor. However, according to a preferred embodiment of the invention the first circuit element comprises—amongst possible other circuit elements like resistors and amplifiers and the like used for operation—a photodiode or a phototransistor. Such a photodiode or phototransistor is the preferred choice because it is a semiconductor device that comprises a junction, which shows significant temperature sensitivity. In this particular embodiment the temperature sensitivity of the junction is used to influence the spectral sensitivity of the photodiode or the phototransistor. As a consequence, during operation, the thermally induced change of the spectral sensitivity of the photodiode or the phototransistor can be used to assess the property of light. Exploiting this change of the spectral sensitivity during operation allows comparing the readings of the photocurrent—which is the output signal—at different junction temperatures during cooldown, which provides some information on the emission wavelength characteristics of the light source. Based on these readings the wavelength of the light emitted—e.g. by a LED—can be calculated and—provided the circuit is used as a sensor in a LED luminary—the result of the calculation can be used to influence the color point accordingly.

In order to increase the temperature of the first circuit element, various measures, ranging e.g. from a heating resistor to a hot air fan, might be applied. However, these measures only allow a propagation of heat from the outside to the inside of the first circuit element and therefore a delay between the generation of the heat and its impact is intrinsic. Hence, in a preferred embodiment of the invention, the second circuit element comprises a current source that is designed to apply a current to the first circuit element. In the case of a photodiode or a phototransistor the current applied is the forward current of the junction of said photodiode or phototransistor. The (forward) current in fact allows directly heating up the first circuit element at its internal temperature-sensitive structure where the current flow takes place. Therefore, it further allows better control of the temperature of that part of the first circuit element that will be used—directly or indirectly—for sensing the property of light. In comparison to indirect heating of the inner structure of the first circuit element from the outside via the second circuit element, direct heating by means of the applied current also improves control of the temperature of the heated part of the first circuit element.

According to a preferred aspect of the invention, the property of light comprises the wavelength. This means that amongst other parameters like flux, lumen and so on the temperature dependency of the first circuit element—so to say the cool-down behaviour of the first circuit element—is primarily used to measure or to determine the wavelength of the light to which the first circuit element is exposed. It is to note that the expression "wavelength" typically does not mean a single value but rather indicates a certain bandwidth of the spectrum of the light.

In a further aspect of the invention, the circuit comprises a third circuit element that is coupled with the first circuit element and is realized to detect a change of the output signal during the measurement time period. For given temperatures of the first circuit element, the change of the output signal will depend on the wavelength of the light to which the first circuit element is exposed. The expression "change of the output signal" may e.g. comprise the difference between values of the output signal measured at different times during the measurement time duration, but may also comprise the change rate of the value representing the output signal, or any other differential representation of the output signal during the cooldown of the first circuit element. Also normalization of such values to a reference value is to be considered within said expression.

Because of the exploitation of the temperature dependency of the first circuit element, it is of importance to acquire information regarding the first circuit element. Accordingly, it is advantageous if the third circuit element is realized to derive information regarding the temperature of the first circuit element, and, based on the derived temperature and the detected change of the output signal, to produce a light-property-signal that represents said property of light. The information regarding the temperature may be derived by using previously compiled look-up tables stored in the third circuit element or may be derived by on-the-fly measurements directly on the output signal during the warming time period—e.g. by means of sensing the forward voltage of a photodiode or a phototransistor that is temperature-dependent—or by measuring or observing other signals in the circuit that appropriately represent the temperature of the first circuit element. However, in a less preferred mode also an external temperature measurement of the temperature of the outer shell of the first circuit element might be used, provided that the measurement timing is set to take into account temperature propagation in the structure of the first circuit element.

According to a further aspect of the invention, the third circuit element is coupled with the second circuit element and is realized to control the second circuit element in order to achieve the increase of the temperature of the first circuit element during the warming time period. This may be realized by applying a fixed timing. However, also the application of a variable timing may achieve the desired temperature cycles of the first circuit element—in particular when combined with a fixed or variable current control determined by the third circuit element and applied to the second circuit element by means of a control signal. Such a current control may depend on the actual and/or desired temperature of the first circuit element.

In particular when using a first circuit element having low output signal driving capabilities, it is advantageous that the circuit comprises a fourth circuit element—between the first circuit element and the third circuit element—that is realized to couple the first circuit element and the third circuit element and that is realized to produce a representation of the output signal to be fed to the third circuit element, wherein the representation of the output signal shows signal parameters that can be easily used/processed by the third circuit element. A feasible realization of the fourth circuit element may e.g. comprise various impedance converters, in particular a so-termed transimpedance converter.

A further aspect of the invention relates to the use of a circuit for sensing a property of light according to the invention in a device, wherein the device comprises a number of light sources for producing light to which the first circuit element is exposed and a driver module that is realized to control the light sources in dependency on the sensed property of light. In a preferred embodiment of the invention, the controller realizes at least the driver module and the third circuit element of the circuit. In a further embodiment the controller may be re-sized to an application-specific integrated circuit and thus comprise the entire circuit according to the invention. The light sources may, for example, be realized by a laser light source or by fluorescent lamps.

According to a particular embodiment, the device is a light emitting diode luminary comprising a number of light emitting diodes. Such LEDs typically show a quite narrow bandwidth in their spectrum, and hence, as will become clear from the following descriptions in this document, render the spectral sensor realized by the circuit according to the invention suitable for adjusting the color point—or compensating a wavelength drift—of such a LED luminary.

Other objects and features of the present invention will become apparent from the following detailed descriptions considered in conjunction with the accompanying drawings. It is to be understood, however, that the drawings are designed solely for the purpose of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF EMBODIMENTS

Figure 1:
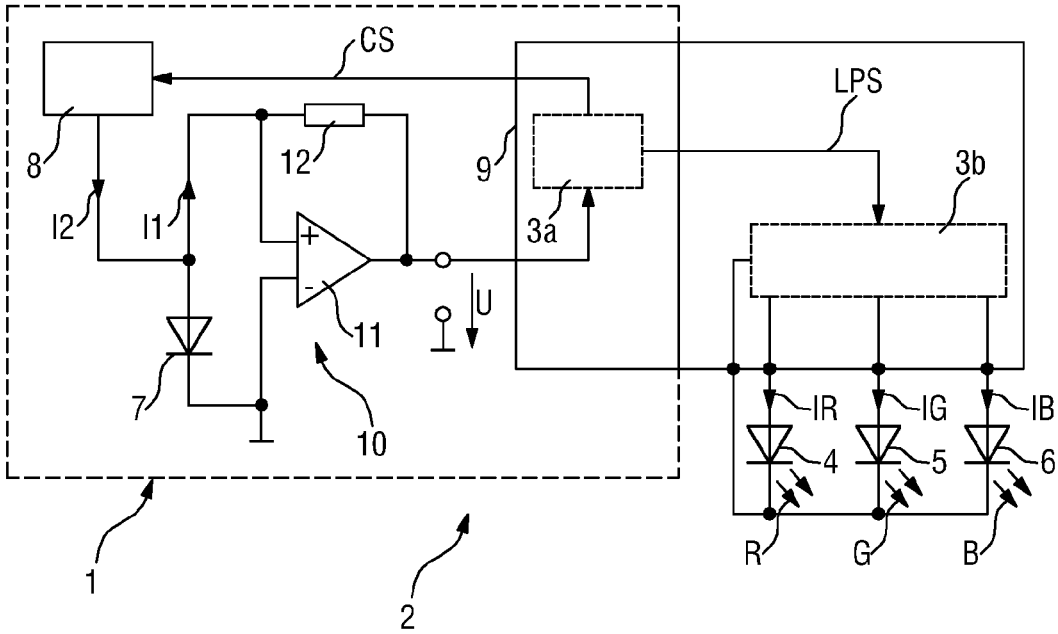
FIG. 1 shows in the form of a schematic diagram a LED-luminary comprising a preferred embodiment of a circuit according to the invention.

FIG. 1 shows a circuit 1 for sensing a property of light. The circuit 1 is used in a light emitting diode (LED) luminary 2. Such a LED luminary 2 may also be termed LED lamp. The luminary 2 comprises in addition to the circuit 1 a driver module 3*b* connected to a first LED 4 realized to emit red light R and a second LED 5 realized to emit green light G and a third LED 6 realized to emit blue light B. The driver module 3*b* is comprised in a controller 9, which in the present case is realized by means of a programmable device having signal processing-, data storage-, and LED driving-capabilities. Based on these controller features the driver module 3*b* is realized to generate driving-currents IR, IG, and IB, each for driving the respective LED 4, 5 and 6 in order to generate light having a particular intensity and causing a certain color impression at the human's eye. The setting of the driving-currents IR, IG, and IB is determined in dependency on the sensing response of the circuit 1, which will be explained in detail below.

In order to sense not only an integral intensity of the light produced by the luminary's LEDs 4, 5, and 6 alone or in combination with each other, the circuit 1 comprises a photodiode 7, which realizes a first circuit element that is sensitive to light and that is realized to generate an output signal. Although the photodiode 7 is schematically depicted remote from the LEDs 4, 5, and 6, it should be clear that the location and orientation of the photodiode 7 should be such that it receives the light emitted by said LEDs 4, 5, and 6. The output signal of the photodiode 7, which is a photo current I1 of the photodiode 7, is generated according to the light to which the photodiode 7 is exposed or in other words the photocurrent I1 is dependent on light to which the photodiode 7 is exposed. However, not only the light determines the photocurrent I1 but also the temperature of the photodiode 7—in particular the temperature of its junction—influences the photocurrent I1.

Figure 2A:
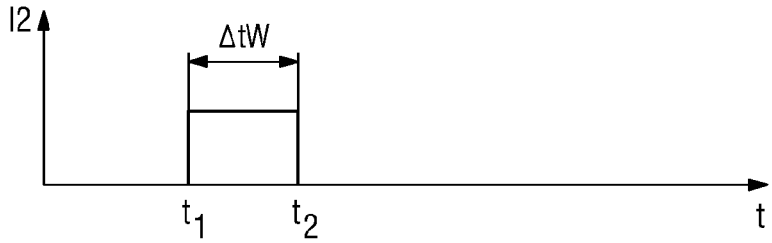
FIG. 2*a* shows a simplified timing diagram of a warming current pulse applied to a light sensitive first circuit element of the circuit of FIG. 1.
Figure 2B:
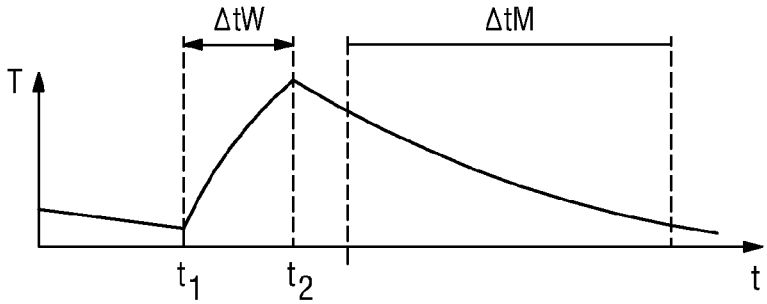
FIG. 2*b* shows in a similar manner as FIG. 2*a* the temperature behaviour of the first circuit element over time in dependency on the warming current pulse.

In order to utilize this temperature dependency, the circuit 1 comprises a current source 8 coupled to the photodiode 7 and realized to drive the photodiode 7 with a forward current I2 during a warming time period ΔtW between the time marker t1 and t2 as shown in FIG. 2*a*, in which the forward current I2 is plotted over time t. During the warming time period ΔtW the junction of the photodiode 7 is heated up as indicated in FIG. 2*b*, in which the junction temperature T is plotted over the time t. After the elapse of the warming time period ΔtW the junction temperature T decreases and subsequently to the warming time period ΔtW the photo current I1 is measured during a measurement time period ΔtM.

The measurement of the photocurrent I1 is performed and evaluated by a third circuit element 3*a* of the circuit 1. Similar to the driver module 3*b* the third circuit element 3*a* is embedded in and realized by the aid of the controller 9, e.g. by means of an input/output stage of the controller 9 and software executed by the controller 9. As schematically depicted in FIG. 1, the third circuit element 3*a* is coupled with the photodiode 7 via a trans-impedance converter 10 that forms a fourth circuit element of the circuit 1. The converter 10 is realized in a conventional manner by an operational amplifier 11 and a resistor 12 connected with each other according to FIG. 1 and connected with the photodiode 7 at its input and with the third circuit element 3*a* at its output. By means of the converter 10 a representation U of the photocurrent I1 is generated that can be processed by the third circuit element 3*a*.

In order to achieve the appropriate timing of the increase of the temperature of the photodiode 7 and consequently also the appropriate junction temperature T at the end of the warming time period ΔtW, the current source 8 and the third circuit element 3*a* are realized to cooperate. On the one hand the third circuit element 3*a* is coupled to the current source 8 and realized to control the generation of the forward current I2 during a time window t2–t1 by the aid of a control signal CS, while on the other hand the current source 8 is realized to perform according to a control signal CS supplied by the third circuit element 3*a*.

Figure 3:
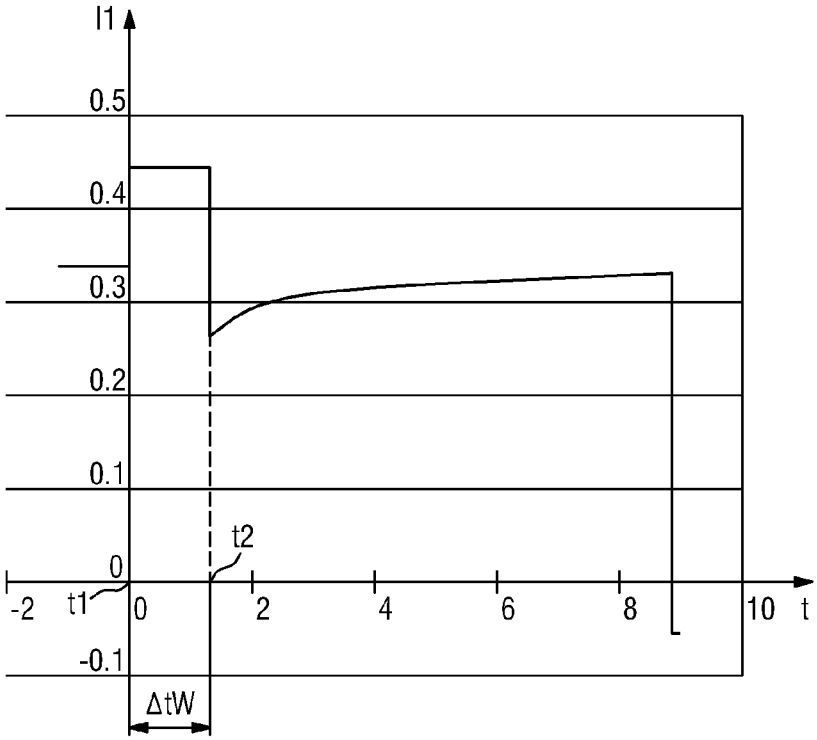
FIG. 3 shows a graph of a photocurrent of the first circuit element measured over time when exposed to light of a first wavelength.
Figure 4:
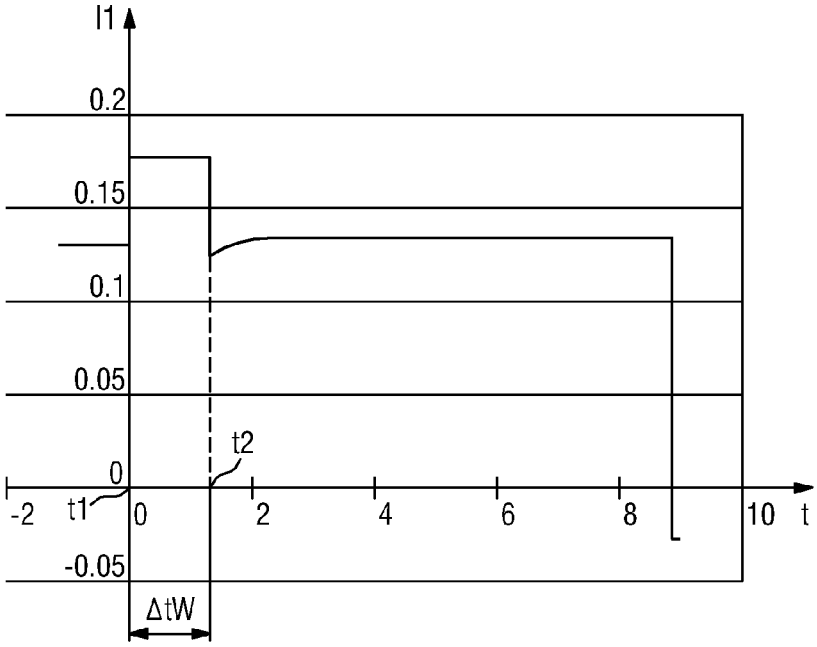
FIG. 4 shows in a similar manner as FIG. 3 a behaviour of the photocurrent of the first circuit element measured over time when exposed to light of a second wavelength.

Reference is now made to FIGS. 3 and 4 in order to explain the usability of the junction temperature T when sensing a property of light by means of the photodiode 7. In FIG. 3 and FIG. 4 the measured photocurrent I1 of the photodiode 7 is plotted over time. FIG. 3 differs from FIG. 4 in the wavelength of the light to which the photodiode 7 is exposed. For FIG. 3 only the blue LED 6 was used, while for FIG. 4 only the red LED 4 was used. Before time marker t1 the junction temperature T was cooled-down to room temperature and the respective LED 4 or 6 illuminated the photodiode 7. During the warming time period ΔtW the forward current I2 was fed to the photodiode 7 and consequently the photocurrent I1 shows saturation. At time marker t2 the forward current I1 was switched off. Thereafter the photocurrent I1 when comparing FIG. 3 with FIG. 4 shows a quite different change over time during the decrease of the junction temperature T.

Figure 5:
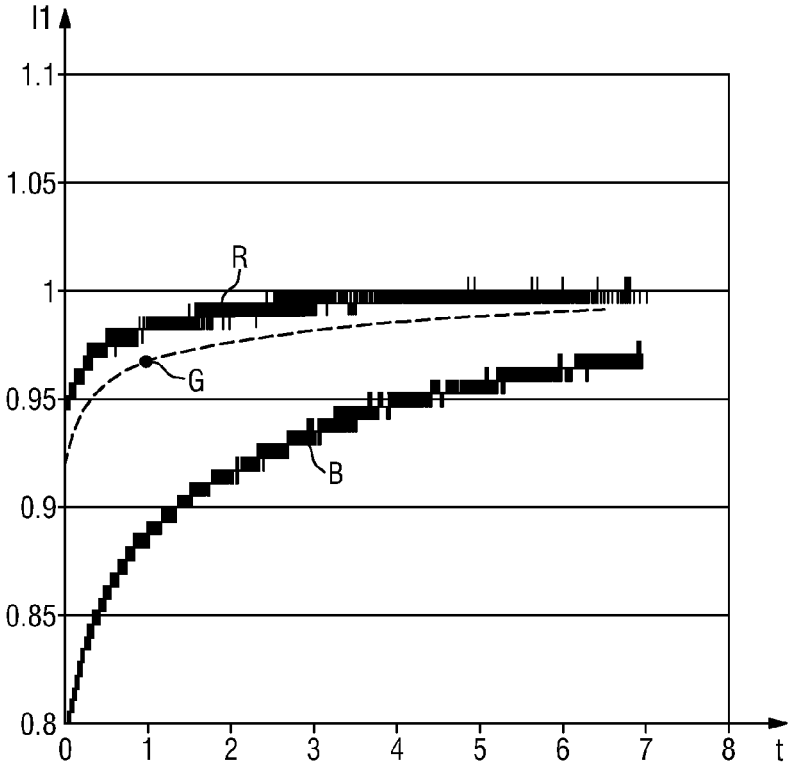
FIG. 5 shows a graph with three normalized photocurrents measured over time and generated by the first circuit element when exposed to light of three different wavelengths.

When looking into details of FIG. 3 and FIG. 4 it becomes clear that it is not the absolute values of the photocurrent I1, but rather the difference in the relative change of the photocurrent I1 that is of interest in the present context when sensing the property of light, wherein the interesting property of light is the wavelength. This aspect is visualized in more details in FIG. 5, where normalized photocurrents I1 caused individually by red light R, green light G, and blue light B are plotted over time t during the decrease of the junction temperature T. For the purpose of normalization prior measurements of the photocurrent I1 under separate red light R, green light G, and blue light B exposure are performed at room temperature as the junction temperature T. In particular in case of exposing the photodiode 7 to blue light B and red light R, respectively, the change or rate of change of the photocurrents I1 significantly differs from each other over time t during the cooldown of the junction. For the sake of clarity it is to be mentioned that the warming time period tΔW, during which the forward current I2 is applied, is not shown in FIG. 5.

Figure 6:
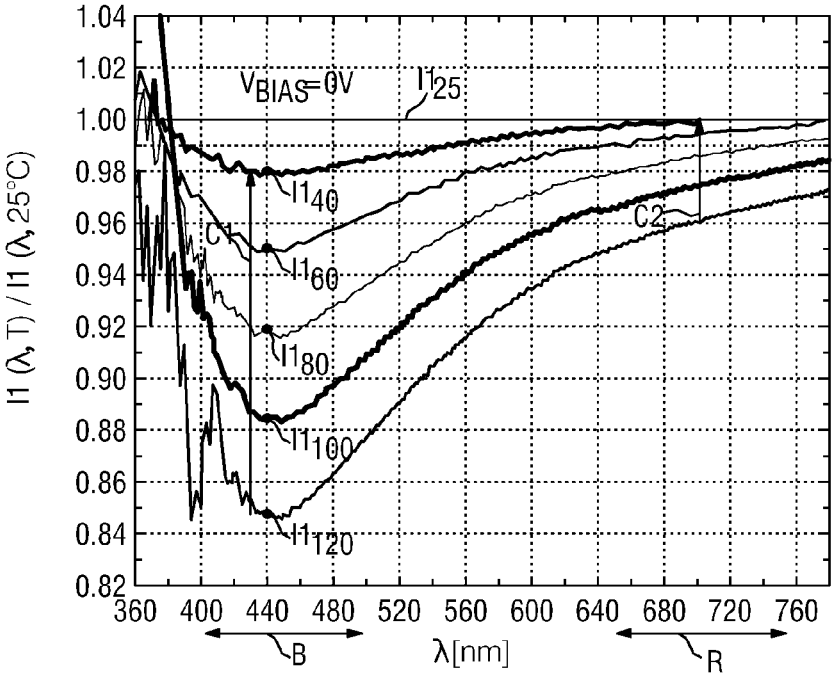
FIG. 6 shows a graph illustrating the temperature dependency of the relative spectral response of the first circuit element.

This effect is now utilized to measure the (dominant) wavelength of the light to which the photodiode 7 is exposed. The principle of the measurement is best described by means of FIG. 6 that shows six normalized photocurrents I1, which are labelled $I1_{25}$, $I1_{40}$, $I1_{60}$, $I1_{80}$, $I1_{100}$, and $I1_{120}$, wherein the respective index indicates the junction temperature T in ° Celsius. A reference photocurrent $I1_{25}$ is measured at a junction temperature T of 25° Celsius over a spectral range of wavelengths λ between 360 nm (near ultra violet) and 780 nm (red). In comparison with the reference photocurrent $I1_{25}$ and in comparison with each other, the remaining photocurrents $I1_{40}$ to $I1_{120}$ show decreased signal levels at higher temperatures over the entire spectral range.

After establishing the array of curves, the present invention utilizes the knowledge of a relative signal change at a given wavelength λ, in order to sense the wavelength of the light to which the photodiode 7 is exposed. For example, when exposing the photodiode 7 to a blue light B, which has a dominant wavelength λ, in the range between 420 nm to 490 nm, and measuring the signal change C1 (increase) of the value of the photocurrent I1 during cooldown of the junction, the measured signal change C1 is significantly higher than a signal change C2 that would occur for a red light R, which has a dominant wavelength λ, in the range between 650 nm to 750 nm.

In the circuit 1 shown in FIG. 1 the third circuit element 3*a* performs the measurement of the change of the photocurrent I1 over time t. It is also the third circuit element 3*a* that correlates the actual junction temperature T of the photodiode 7 with the measurements taken over time t during the measurement time period λtM. During operation, the actual junction temperature T is derived by a functional description describing the junction temperature T in dependency on a set of operation parameters (duration of the warming time period ΔtW, value of the forward current I2 or variations of this value, time elapsed after time marker t2, duration of measurement time period ΔtM, environment temperature, and so on). Alternatively, inherent knowledge of the junction temperature T may also be provided by means of a look-up table in which the junction temperature T and corresponding operation parameters are stored. The junction temperature T might also be directly derived by measuring the forward voltage value sensed at the photodiode 7. This measurement may be performed during the warming time period ΔtW or in intermitted forward voltage sensing intervals during ΔtW and/or ΔtM. Preferably, the third circuit element 3*a* sets the second circuit element 8 to produce a dedicated sensing current level while the forward voltage measurements are performed. Typically, this sensing current will be lower than the forward (heating) current I2 applied during ΔtW.

Based on the derived junction temperature T and the measured change of the photocurrent I1 during the measurement time period ΔtM, the third circuit element 3*a* generates a light-property-signal LPS that represents the wavelength λ—in particular its value or a range of values—of the light. The light-property-signal LPS is used to further adjust the driving currents IR, IG and IB in order to set the desired color point of the integral light emitted by the LED luminary 2. This is performed with the aid of the driver module 3*b*. However, although the third circuit element 3*a* and the driving module 3*b* are depicted separate from each other for the sake of easy explanation of the operation of the LED luminary only, it is to be mentioned that the third circuit element 3*a* and the driver module 3*b* may in reality be combined.

Figure 7:
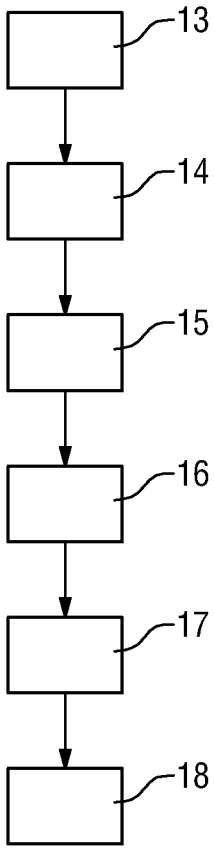
FIG. 7 shows in the form of a flow chart an embodiment of a method according to the invention.

In the following, the operation of the circuit 1 is briefly discussed by means of a method according to the invention, which is visualized in FIG. 7. Said method commences in a block 13, wherein it is assumed that the junction temperature T of the photodiode 7 is known to the third circuit element 3*a* and is e.g. equal to 25° C. But also any other temperature, which might depend on the location of the photodiode 7 and/or its exposure to heat generated by heat sources in its environment, e.g. the LEDs 4, 5 and 6, may be considered by the third circuit element 3*a* during operation. As the type of photodiode 7 is known to the third circuit element 3*a*, the third circuit element may derive this temperature during temperature detection measurements.

In a block 14 the red LED 4 is switched on and the forward current I2 is fed to the photodiode 7 for the warming time period ΔtW. When the warming time period ΔtW has elapsed, the forward current I2 is shut off and—with a slight delay—the increase of the photocurrent I1 is measured during the measurement time period ΔtM. The third circuit element 3*a*, which has full knowledge of the junction temperature T during the measurement time period ΔtM, computes a dominant first spectral component of the light to which the photodiode 7 is exposed and stores data representing a value of said dominant first spectral component. Next, in a block 15 the green LED 5 is switched on and the above described activities during the warming time period ΔtW followed by the measurement time period ΔtM are repeated and a dominant second spectral component of the light to which the photodiode 7 is exposed is computed and further data are stored. Finally, in a block 16 the blue LED 6 is switched on and the above-described activities during the warming time period ΔtW followed by the measurement time period ΔtM are repeated and a dominant third spectral component of the light to which the photodiode 7 is exposed is computed and further data are stored. In a subsequent block 17 the three stored dominant spectral components are thereafter used in a model to compute the adjustment of the three driving-currents IR, IG and IB that are necessary to adjust the color point of the LED luminary 2 in order to match the desired color point. The method ends in a block 18.

Depending on the application, i.e. on the question how fast the light spectrum of the LEDs is expected to change during operation, the steps of the method are repeated sooner or later.

According to a further embodiment the three individual warming time periods ΔtW might be avoided and only one common warming time period ΔtW might be used before the property of light is sensed for each LED 4, 5, and 6 in a consecutive manner during one common measurement time period ΔtM. The three LEDs are successively switched on and off during the common measurement time period ΔtM.

However, in a further embodiment of the invention, the common measurement time period ΔtM might be divided into three individual consecutive measurement time periods ΔtM with or without break periods between each other, each measurement time period ΔtM being associated with one of the LEDs 4, 5, and 6 for which the property of light is to be sensed.

In a further embodiment an initial reference measurement of the photocurrent I1 at room temperature (25° C.) can be performed for each of the three LEDs 4, 5, and 6, which serves as a reference value for normalization. Thereafter, during the measurement time period ΔtM the three LEDs 4, 5, and 6 are consecutively switched on and off a number of times (cycles) during cooldown of the junction. For example, during a first cycle the photocurrent I1 caused by the red LED 4 is measured at 120° C., the photocurrent I1 caused by the green LED 5 is measured at 112° C., and the photocurrent I1 caused by the blue LED 6 is measured at 105° C. Thereafter, during a second cycle the photocurrent I1 caused by the red LED 4 is measured at 99° C., the photocurrent I1 caused by the green LED 5 is measured at 93° C., and the photocurrent I1 caused by the blue LED 6 is measured at 88° C. Further cycles are applied during cooldown and—online or after all the measurements are finalized—the measurements of the photocurrent I1 normalized to the reference measurement for each color of the LEDs 4, 5, and 6 are used to determine the change in the photocurrent I1 during the measurement time period ΔtM.

The present invention may also be used for judging the ambient light. For this purpose all LEDs will be switched off and the dominant spectral contribution of the ambient light will be determined. Due to the fact that the spectral composition of sunlight typically shows a stronger contribution in the red spectral range as compared to a fluorescence lamp, it will be possible to distinguish between artificial indoor light conditions and natural outdoor light conditions.

A further application of the invention may be found in the field of "reproducing" the ambient light, e.g. at a certain time like in the evening hours when the light shows a significant "warm" red contribution. Therefore the spectral composition of the ambient light is assessed during several measurements and the current setting of the LEDs 4, 5, and 6 is e.g. iteratively adjusted until the spectral composition of the light emitted by the LED luminary 2 is similar to the desired daylight condition.

But also "compensating" the actual ambient light perception towards a desired light perception can be achieved by using the present invention. In order to achieve said compensation the environmental light is assessed, its spectral deviation from desired spectral composition is computed, and the required current settings for the LEDs 4, 5, and 6 of the LED luminary 2 are set in order to achieve the desired spectral composition of the combination of the light of the LED luminary 2 and the ambient light. This feature may be based on a dedicated model or its realization may be achieved by means of iteration of LED current settings.

In summary, but without being comprehensive, the present invention may find its field of application for example in color control and/or aging compensation of LED lamps. It might even be applied in a more general context e.g. in a color controller for automatically detecting connected (color of) LEDs, detecting color deviations from desired color settings, spectral daylight analyses/sensing and spectral ambient light compensations and so forth.

In particular, when applying the invention in the context of detecting connected LEDs, the method comprises detecting a change of the output signal I1 during the measurement time period ΔtM by means of a third circuit element 3*a* that is coupled with the photodiode 7. Information regarding the temperature T of the photodiode 7 is derived by the third circuit element 3*a* and, based on the derived temperature T and the detected change of the output signal I1, a light-property-signal LPS that represents said property of light is generated by the third circuit element 3*a*. This allows the implementation of a method of applying a color control strategy to light sources, e.g. LEDs 4 and 5 and 6, used to generate light, wherein the method comprises the steps of activating the light sources 4 to 6, and using the method according to the invention for generating said light property signal (LPS), and selecting based on the light property signal LPS a color control strategy for controlling the light sources 4 to 6. The controlling typically comprises adjusting the driving currents of the LEDs. The color control strategy may comprise a set of parameters for controlling the LEDs, which set of parameters is uploaded into the LED luminary 1, e.g. into the controller 9, or any device used to control the LED's light generation. Activation of the light sources 4 to 6 might be realized in a group-wise fashion or individually.

As a consequence, when using the invention for detecting connected (color of) LEDs, the third circuit element 3*a* does not have to be knowledgeable (e.g. by programming or initialization in the factory) about the different LEDs present in the lamp. At start-up, the third circuit element activates the different LEDs and measures the light property. Based on the light-property-signal LPS, it will be possible to detect whether e.g. a set of red, green and blue or a set of amber, warm white and cold white LEDs is present in the lamp. Based on this detection, different color control strategies can be used, e.g. to have a better support for a wide color gamut or to optimize towards high color rendering quality for white light.

In general, and not only focusing on the last-mentioned aspect of the invention, especially when more than three colors are present in the lamp, knowledge about the dominant wavelength of the primary colors is an important feature. This knowledge can be easily provided by the invention.

The invention, or parts of it, may be implemented by means of hardware comprising several distinct elements, and/or by means of a suitably programmed processor. In the last-mentioned case it can be said that at least that part of the invention relating to the processing of data and/or signals may also be realized by means of a computer program product, which can reside in a memory of a device, e.g. of the controller 9, and which can be executed by a processor of said device or which can reside on a computer readable medium, e.g. a solid state memory device or an optical data carrier like a CD, DVD or a network-based server or the like, so that the computer program can be loaded from the computer readable medium into a device, e.g. a computer or laptop or other suitable device, where it will be executed.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several elements, several of these elements may be embodied by one and the same item of hardware or by a number of individual items. The mere fact that certain measures are recited in mutually different dependent claims does not indicate that a combination of these measures cannot be used to advantage.

The invention claimed is:

1. A circuit for sensing a property of light, the circuit comprising a first circuit element that is sensitive to light and is configured to generate an output signal during a measurement time period, wherein the output signal is generated according to light to which the first circuit element is exposed and the temperature of the first circuit element, a second circuit element that is configured to increase the temperature of the first circuit element during a warming time period that precedes the measurement time period, and a third circuit element that is coupled with the first circuit element and is configured to detect a change of the output signal during the measurement time period, wherein the third circuit element is configured to derive information regarding the temperature of the first circuit element and, based on the derived temperature and the detected change of the output signal, to generate a light-property-signal that represents said property of light.

2. The circuit according to claim 1, wherein the first circuit element comprises a photodiode or a phototransistor comprising a junction.

3. The circuit according to claim 1, wherein the second circuit element comprises a current source that is configured to apply a current to the first circuit element.

4. The circuit according to claim 1, wherein the property of light comprises the wavelength.

5. The circuit according to claim 1, herein the circuit comprises a fourth circuit element that is configured to couple the first circuit element and the third circuit element and that is configured to produce a representation of the output signal to be fed to the third circuit element.

6. A device comprising a circuit according to claim 1, wherein the device comprises a number of light sources for producing light to which the first circuit element is exposed and a driver module that is configured to drive the light sources in dependency on the sensed property of light.

7. The device according to claim 6, wherein the device is a light emitting diode luminaire comprising a number of light emitting diodes as the light sources.

8. A method of sensing a property of light with a circuit that comprises a first circuit element, a second circuit element, and a third circuit, which method comprises the steps of:

exposing said first circuit element to light, and increasing the temperature of said first circuit element by means of said second circuit element during a warming time period that precedes a measurement time period, and generating an output signal by means of said first circuit element during the measurement time period, wherein the output signal is generated according to the light to which the first circuit element is exposed and the temperature of the first circuit element, detecting a change of the output signal during the measurement time period by the third circuit, wherein the third circuit is coupled with the first circuit element, deriving information regarding the temperature of the first circuit element, and based on the derived temperature and the detected change of the output signal, generating a light-property-signal that represents said property of light.

9. The method according to claim 8, wherein the output signal is generated by means of a photodiode or a phototransistor comprising a junction.

10. The method according to claim 8, wherein the increase of the temperature of the first circuit element is performed by means of a current source that is configured to apply a current to the first circuit element.

11. The method according to claim 8, wherein a change of the output signal is detected during the measurement time period by means of a third circuit element that is coupled with the first circuit element.

12. A circuit for sensing a property of light, the circuit comprising a first circuit element that is sensitive to light and is configured to generate an output signal during a measurement time period, wherein the output signal is generated according to light to which the first circuit element is exposed and the temperature of the first circuit element, and a second circuit element that is configured to increase the temperature of the first circuit element during a warming time period that precedes the measurement time period, wherein the circuit comprises a third circuit element that is coupled with the first circuit element and is configured to detect a change of the output signal during the measurement time period, wherein the third circuit element is coupled with the second circuit element and is configured to control the second circuit element in order to achieve the increase of the temperature of the first circuit element during the warming time period.

13. The circuit according to claim 12, wherein the first circuit element comprises a photodiode or a phototransistor comprising a junction.

14. The circuit according to claim 12, wherein the circuit comprises a fourth circuit element that is configured to couple the first circuit element and the third circuit element and that is configured to produce a representation of the output signal to be fed to the third circuit element.

15. A device comprising a circuit according to claim 12, wherein the device comprises a number of light sources for producing light to which the first circuit element is exposed and a driver module that is configured to drive the light sources in dependency on the sensed property of light.

16. The device according to claim 15, wherein the device is a light emitting diode luminaire comprising a number of light emitting diodes as the light sources.

* * * * *